US007937879B2

(12) United States Patent
Hamilton

(10) Patent No.: US 7,937,879 B2
(45) Date of Patent: May 10, 2011

(54) RIFLE SCOPE WITH A LOW-LIGHT VISIBLE ELEMENT

(75) Inventor: Samuel J. Hamilton, Mount Horeb, WI (US)

(73) Assignee: Sheltered Wings, Inc., Middleton, WI (US)

( * ) Notice: Subject to any disclaimer, the term of this patent is extended or adjusted under 35 U.S.C. 154(b) by 239 days.

(21) Appl. No.: 12/381,324

(22) Filed: Mar. 11, 2009

(65) Prior Publication Data

US 2010/0229451 A1 Sep. 16, 2010

(51) Int. Cl.
*F41G 1/00* (2006.01)

(52) U.S. Cl. ..... 42/132; 42/111; 42/119; 42/122; 42/123; 42/130; 42/131

(58) Field of Classification Search ..... 42/111, 42/119–132, 144–145
See application file for complete search history.

(56) References Cited

U.S. PATENT DOCUMENTS 2,699,141 A * 1/1955 Gaguski ..... 116/332
3,904,279 A * 9/1975 Sanada ..... 359/827
3,990,155 A * 11/1976 Akin et al. ..... 42/122
4,020,203 A * 4/1977 Thuler ..... 250/458.1
4,285,137 A * 8/1981 Jennie ..... 42/122
4,373,269 A * 2/1983 Doliber et al. ..... 42/122
4,554,745 A * 11/1985 Repa ..... 42/126
4,822,994 A * 4/1989 Johnson et al. ..... 250/214 VT
5,044,304 A * 9/1991 Tomita ..... 116/286
5,372,087 A * 12/1994 Kato et al. ..... 116/288
5,414,595 A * 5/1995 Oike et al. ..... 362/489
5,752,759 A * 5/1998 Pizzo ..... 362/26
6,279,259 B1 * 8/2001 Otteman ..... 42/122
6,499,191 B1 * 12/2002 Howie, Jr. ..... 16/441
6,508,026 B1 * 1/2003 Uppiano et al. ..... 42/119
6,608,272 B2 * 8/2003 Garcia ..... 200/316
6,691,447 B1 * 2/2004 Otteman ..... 42/122
6,860,224 B2 * 3/2005 Snider ..... 116/310
6,862,832 B2 * 3/2005 Barrett ..... 42/119
7,203,998 B2 * 4/2007 Howie, Jr. ..... 16/441
7,415,791 B2 * 8/2008 Williams et al. ..... 42/122
7,612,952 B2 * 11/2009 Schafer ..... 359/813
7,793,456 B1 * 9/2010 Lacorte ..... 42/122
7,827,725 B1 * 11/2010 Hagler ..... 42/127
2003/0131516 A1 * 7/2003 Blomdahl ..... 42/111
2003/0192224 A1 * 10/2003 Kirk ..... 42/124
2004/0088898 A1 * 5/2004 Barrett ..... 42/119
2004/0144013 A1 * 7/2004 Leatherwood ..... 42/126
2004/0148841 A1 * 8/2004 Burzel ..... 42/123

(Continued)

*Primary Examiner* — Michelle Clement
(74) *Attorney, Agent, or Firm* — Bennet N. Langlotz; Langlotz Patent & Trademark Works, Inc.

(57) ABSTRACT

Rifle scopes with low-light visible elements include a scope body, a movable optical element defining an optical axis enclosed by the scope body, a turret operably connected to the optical element for adjusting the optical axis, and a low-light visible element attached to the turret such that the rotational position of the turret can be determined by viewing the low-light visible element. A tactile indicator may be attached to the turret such that the rotational position of the turret can be determined by touch. A plurality of indicia may be attached to the perimeter of the turret such that the rotational position of the turret can be determined by viewing the indicia. At least one of the indicia may be visible in low-light conditions.

47 Claims, 6 Drawing Sheets

U.S. PATENT DOCUMENTS

2005/0201076 A1* 9/2005 Marcelle et al. ..... 362/23
2005/0252065 A1* 11/2005 Scherpf ..... 42/123
2006/0171136 A1* 8/2006 Horoho et al. ..... 362/23
2007/0103884 A1* 5/2007 Popowich et al. ..... 362/29
2007/0137089 A1* 6/2007 William et al. ..... 42/122
2007/0175080 A1* 8/2007 Sammut et al. ..... 42/126
2007/0195513 A1* 8/2007 Nishiyama et al. ..... 362/23
2008/0023309 A1* 1/2008 Montalvo ..... 200/332
2009/0241399 A1* 10/2009 Hamilton ..... 42/119
2010/0229451 A1* 9/2010 Hamilton ..... 42/126

* cited by examiner

RIFLE SCOPE WITH A LOW-LIGHT VISIBLE ELEMENT

FIELD OF THE INVENTION

The present invention relates to a rifle scope with a low-light visible element that provides an aid for verifying the position of a turret.

BACKGROUND OF THE INVENTION

A turret is one of two knobs in the outside center part of a riflescope body. They are marked in increments and are used to adjust elevation and windage for points of impact change. Conventional turrets have markings on them that indicate how many clicks of adjustment have been dialed in on the turret, or an angular deviation, or a distance compensation for a given cartridge. A click is one tactile adjustment increment on the windage or elevation turret of a scope.

However, when light conditions are poor, such as at twilight, night, or in darkened rooms of buildings, a turret marking that relies on the user's ability to read it using only unenhanced ambient light is at a disadvantage. Under such conditions, the markings may not be sufficiently visible. This is particularly significant for police and military users of firearms, who in the course of their duties may very likely be confronted with a threat under poor lighting conditions. In addition, hunters may hunt at twilight or in deep shade.

Because of the need for compact riflescope components, markings are necessarily small, making them difficult to read under borderline conditions. While this may be a concern when making fine adjustments, it is a greater concern when a user must make large changes involving several revolutions of a knob, which may lead to an error in the number of revolutions made.

Therefore, a need exists for a new and improved rifle scope with a low-light visible element that provides an aid for counting the number of revolutions that have been dialed in on a turret. In this regard, the various embodiments of the present invention substantially fulfill at least some of these needs. In this respect, the rifle scope with a low-light visible element according to the present invention substantially departs from the conventional concepts and designs of the prior art, and in doing so provides an apparatus primarily developed for the purpose of providing an aid for counting the number of revolutions that have been dialed in on a turret.

SUMMARY OF THE INVENTION

The present invention provides an improved rifle scope with a low-light visible element, and overcomes the above-mentioned disadvantages and drawbacks of the prior art. As such, the general purpose of the present invention, which will be described subsequently in greater detail, is to provide an improved rifle scope with a low-light visible element that has all the advantages of the prior art mentioned above.

To attain this, the preferred embodiment of the present invention essentially comprises a scope body, a movable optical element defining an optical axis enclosed by the scope body, a turret operably connected to the optical element for adjusting the optical axis, and a low-light visible element attached to the turret such that the rotational position of the turret can be determined by viewing the low-light visible element. A tactile indicator may be attached to the turret such that the rotational position of the turret can be determined by touch. A plurality of indicia may be attached to the perimeter of the turret such that the rotational position of the turret can be determined by viewing the indicia. At least one of the indicia may be visible in low-light conditions. There are, of course, additional features of the invention that will be described hereinafter and which will form the subject matter of the claims attached.

There has thus been outlined, rather broadly, the more important features of the invention in order that the detailed description thereof that follows may be better understood and in order that the present contribution to the art may be better appreciated.

BRIEF DESCRIPTION OF THE DRAWINGS

The same reference numerals refer to the same parts throughout the various figures.

DESCRIPTION OF THE CURRENT EMBODIMENT

Figure 1:
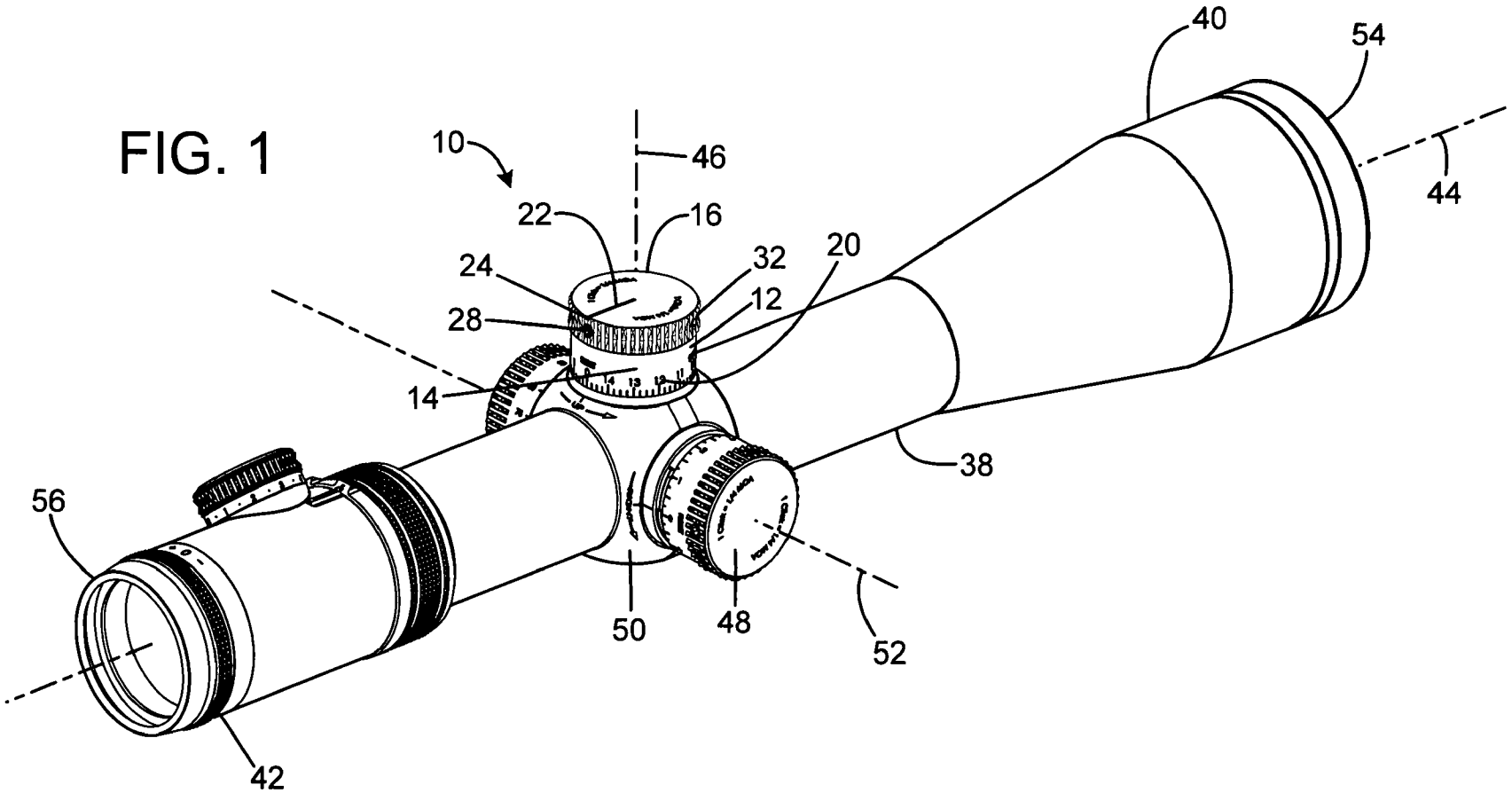
FIG. 1 is a top perspective view of the current embodiment of the rifle scope with a low-light visible element constructed in accordance with the principles of the present invention.

A preferred embodiment of the rifle scope with a low-light visible element of the present invention is shown and generally designated by the reference numeral 10.

FIG. 1 illustrates the improved rifle scope with a low-light visible element 10 of the present invention. More particularly, the rifle scope 10 has a scope body 38 that encloses a movable optical element. The scope body 38 is an elongate tube tapering from a larger opening at its front 40 to a smaller opening at its rear 42. An eyepiece 56 is attached to the rear of the scope body, and an objective lens 54 is attached to the front of the scope body. The center axis of the movable optical element defines the optical axis 44 of the rifle scope.

An elevation turret 12 and a windage turret 48 are two knobs in the outside center part of the scope body 38. They are marked in increments by indicia 20 on their perimeters 14 and are used to adjust the elevation and windage of the movable optical element for points of impact change. These knobs protrude from the turret housing 50. The turrets are arranged so that the elevation turret rotation axis 46 is perpendicular to the windage turret rotation axis 52.

The movable optical element is adjusted by rotating the turrets one or more clicks. A click is one tactile adjustment increment on the windage or elevation turret of the rifle scope, each of which corresponds to an indicium 20. One click may change a scope's point of impact by ¼ inch at 100 yards, but may also be in other click values, such as ½ inch, 0.1 milliradian, etc. In the illustrated embodiment, one click equals ¼ Minute of Angle. Minute of Angle (MOA) is a unit of measurement of a circle, which is 1.0472 inches at 100 yards. Conventionally, it is referred to as being 1 inch at 100 yards, 2 inches at 200 yards, 5 inches at 500 yards, ½ inch at 50 yards, etc.

Figure 2:
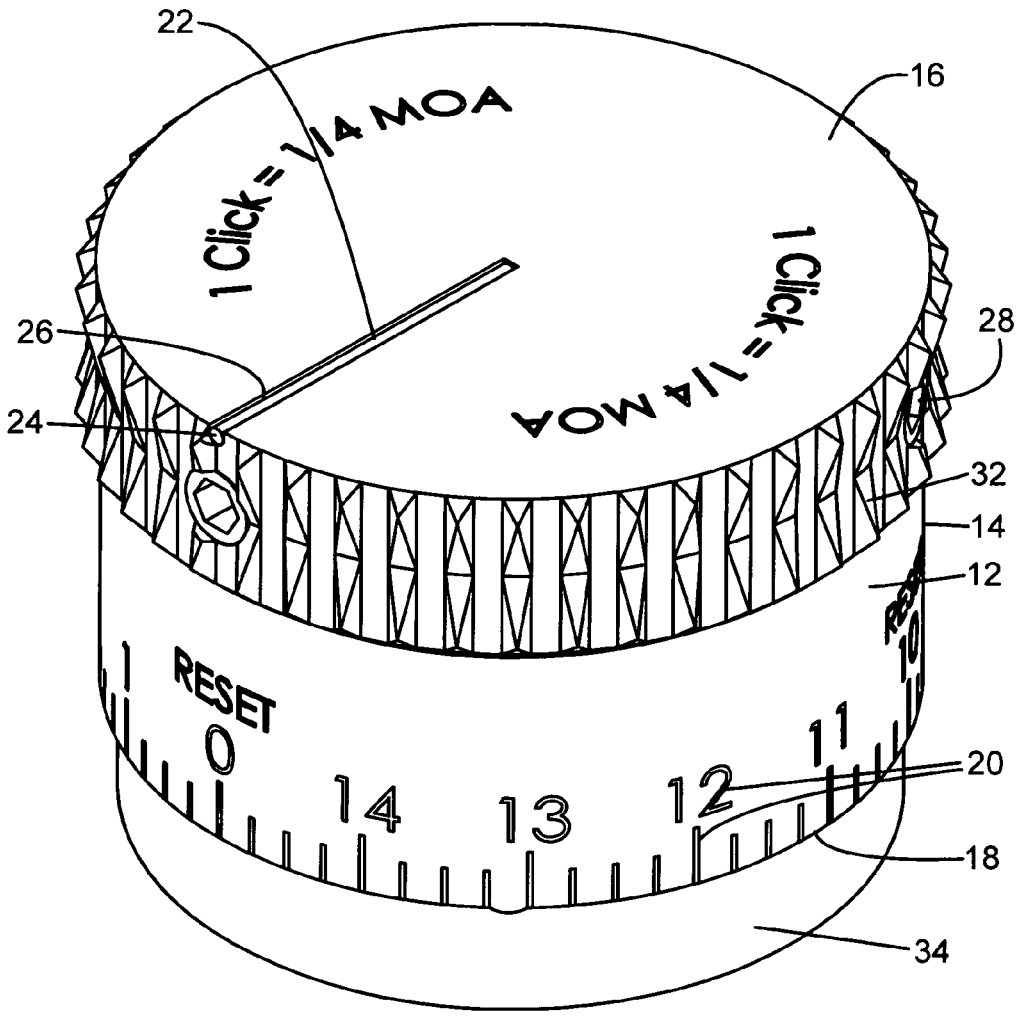
FIG. 2 is a top perspective view of the current embodiment of the elevation turret of the present invention.

FIG. 2 illustrates the improved elevation turret 12 of the present invention. More particularly, the elevation turret 12 is a cylindrical body with a top 16, a bottom 18, and a perimeter 14. A tactile indicator 26 is present on the top 16 of the turret 12. In the illustrated embodiment, the tactile indicator 26 is a recessed groove. A low-light visible element 22 is received by the groove. Both the low-light visible element and the groove enable the rotational position of the turret 12 to be determined by touch in very dark conditions when even the low-light visible element is not visible or when the turret is not in view or being looked at.

The top portion 32 of the perimeter 14 of the turret 12 is knurled or otherwise textured or ruggedly contoured to facilitate gripping for rotation of the turret 12. Indicia 20 are positioned around the perimeter 14 and correspond to clicks of the turret 12. Indicia typically include tick marks, each corresponding to a click, and larger tick marks at selected intervals, as well as numerals indicating angle of adjustment or distance for bullet drop compensation. Bolts 28 connect the turret 12 to a turret screw 36 (shown in FIG. 4) protruding from the bottom 18 of the turret 12 through a turret base 34. The turret base is mated to the scope body 38 and remains in a fixed position with respect to the scope body when the turret is rotated. The bolts 28 permit the turret 12 to be re-zeroed or completely detached from the turret screw. Zero is the distance the rifle scope is sighted in at when no clicks have been dialed in on the turret 12 and references the flight of the projectile. If the rifle scope is sighted in at 200 yards, it is said to have a 200 yard zero.

Figure 3:
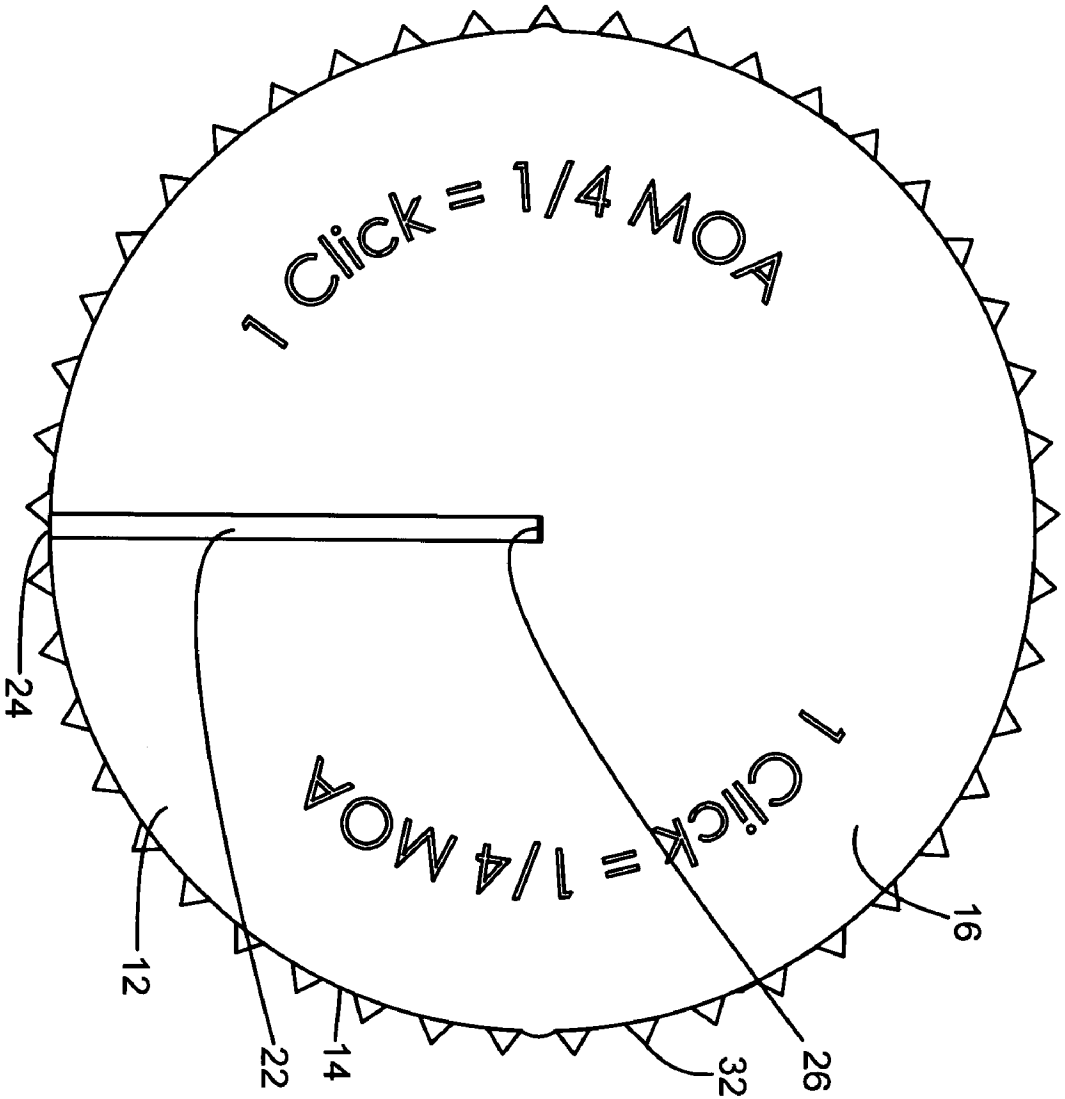
FIG. 3 is a top view of the current embodiment of the elevation turret of the present invention.

FIG. 3 illustrates the improved elevation turret 12 of the present invention. More particularly, the elevation turret 12 has a tactile indicator 26 on its top 16 that receives a low-light visible element 22. In the illustrated embodiment, the low-light visible element 22 is an acrylic fiber optic filament or rod. The length of the fiber optic filament is 15.50 mm, and its diameter is 0.74 mm (0.029 in). Fiber optic filaments effectively capture diminutive amounts of ambient light and magnify it to a usable light source. Ideally, they include fluorescent material that responds to ambient light entering the sides of the filament and fluoresces to provide a bright appearance at the end of the filament or rod. Because of the presence of shorter wavelengths of light in typical twilight conditions, this provides a more vivid appearance of illumination than would be generated by twilight reflecting off a white spot. Thus, such materials have been used in gun sights to indicate the front post of a pistol, or bead of a shotgun, as well as to provide an illuminated dot in the reticle of a riflescope.

The elongated fiber optic filament provides an enhanced surface area over which to harness ambient light. Accordingly, the tip 24 of the fiber optic filament is illuminated as a result of the harnessed ambient light. This makes the low-light visible element capable of assisting shooters in determining the rotational position of the turret 12 by viewing the tip of the low-light visible element when the indicia 20 are not sufficiently visible in low-light environments. Because the filament responds to ambient light, it provides a brightness that is proportional to the ambient light level, avoiding under illumination in bright environments and over illumination in darker environments.

Figure 4:
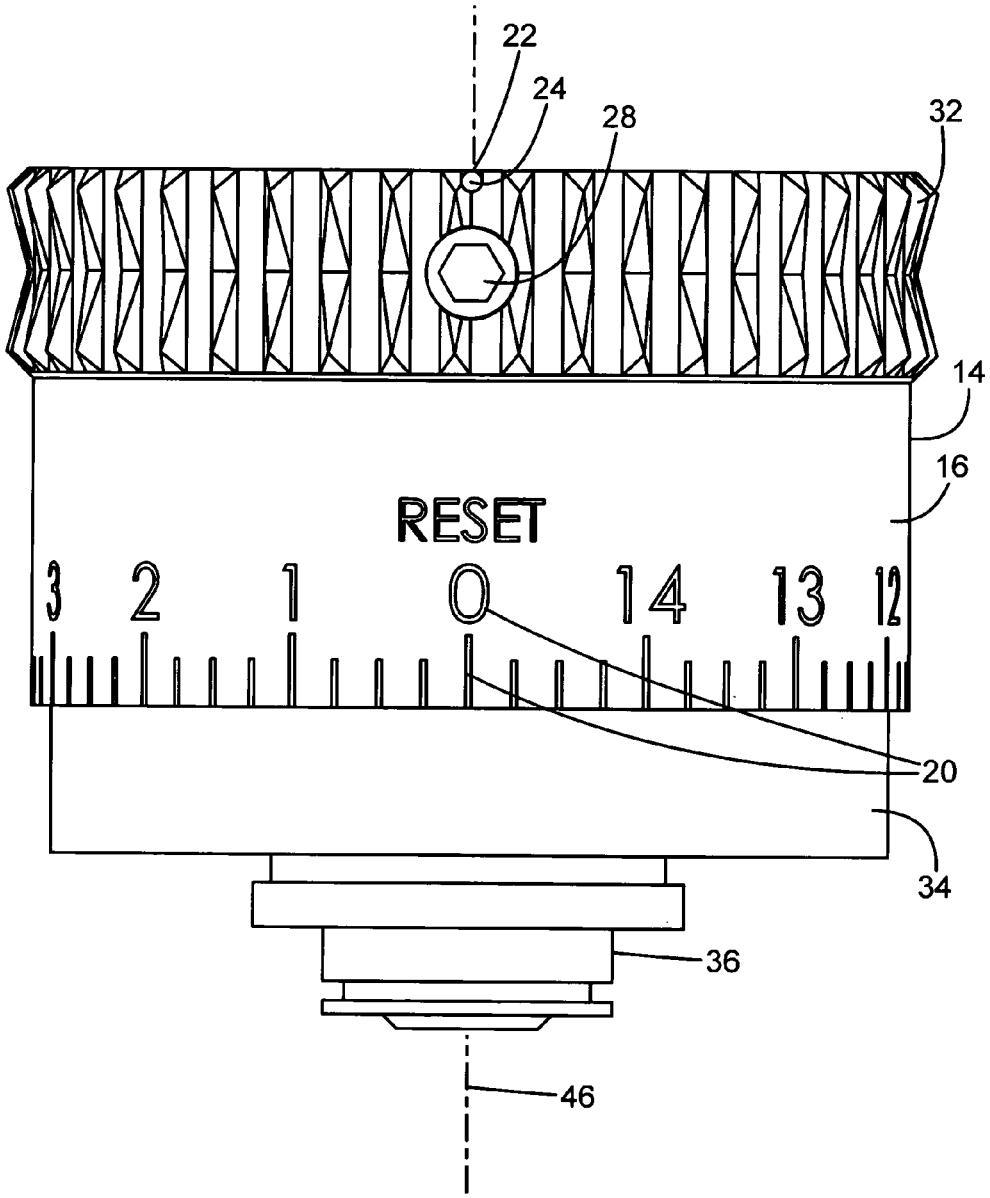
FIG. 4 is a side view of the current embodiment of the elevation turret of the present invention.

FIG. 4 illustrates the improved elevation turret 12 of the present invention. More particularly, the elevation turret 12 has a tactile indicator 26 on its top 16 that receives a low-light visible element 22. The tactile indicator pierces the perimeter 14 of the turret 12, which permits the tip 24 of the low-light visible element to be exposed and visible laterally from and perpendicular to an axis 46 defined by the rotation of the turret 12, as it would be viewed by a shooter positioned to look through the scope's eyepiece. The turret screw 36 is operably connected to the movable optical element and adjusts the optical axis based on the number of clicks that have been dialed in on the turret 12. In the illustrated embodiment, the tactile indicator and low-light visible element are positioned to correspond to 0 Minutes of Angle of adjustment to the optical axis (no clicks). In this position, the low-light visible element and tactical indicator point towards the user and are aligned with the "0" indicium. However, the tactile indicator and low-light visible element can be positioned to correspond to any quantity of clicks and do not necessarily have to be positioned to both correspond with the same quantity of clicks. Furthermore, there may be multiple tactile indicators and/or low-light visible elements, each positioned to correspond to a different quantity of clicks. The low-light visible elements may be different colors to differentiate them from one another. For instance, there may be one color associated with zero elevation, and other colors associated with hundred yard distance settings, or full MOA amounts.

Figure 5:
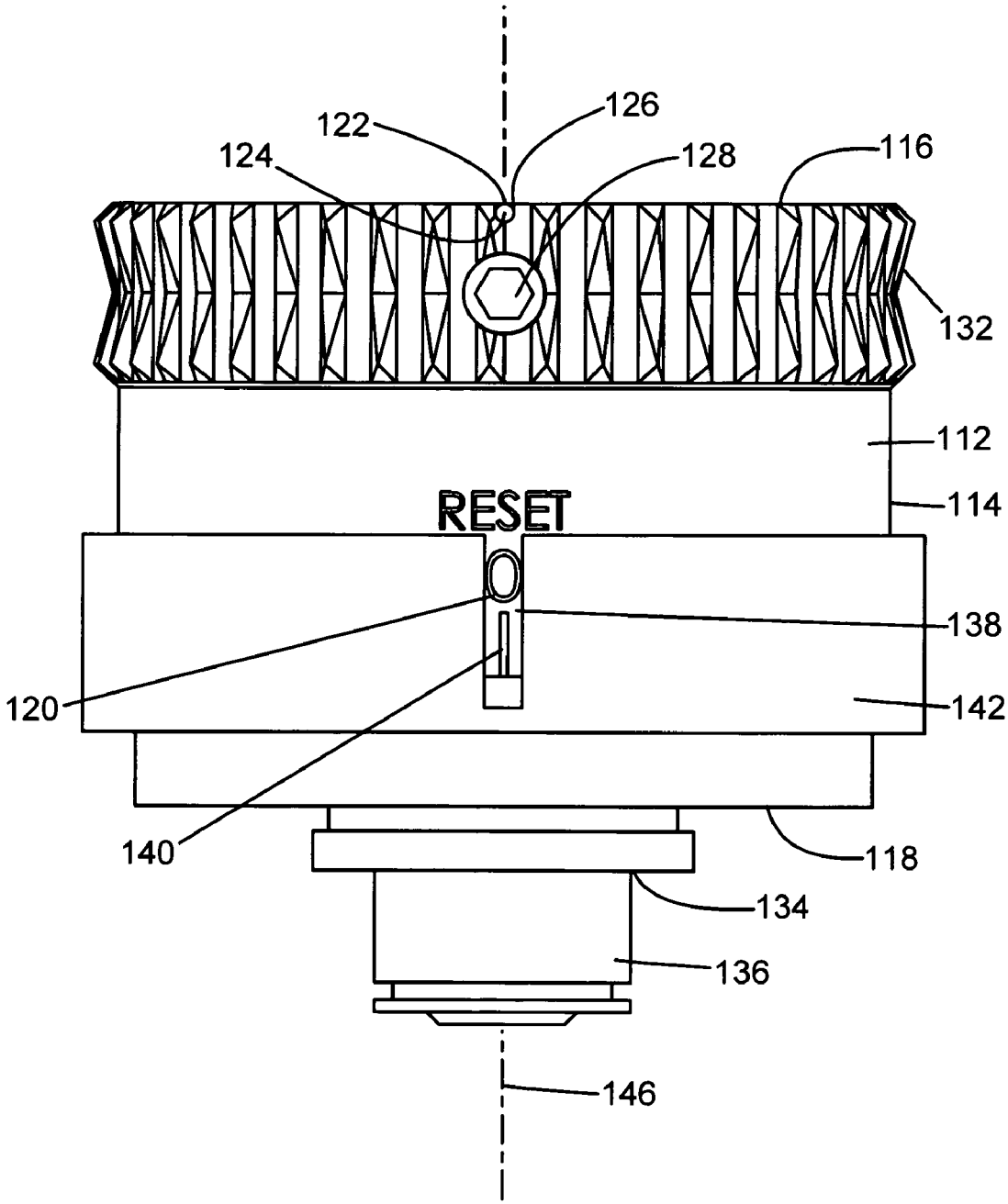
FIG. 5 is a top perspective view of an alternative embodiment of the elevation turret of the present invention.

FIG. 5 illustrates an alternative embodiment of the improved elevation turret 112 of the present invention. More particularly, the elevation turret 112 is a cylindrical body with a top 116, a bottom 118, and a perimeter 114. A tactile indicator 126 is present on the top 116 of the turret 112. In the illustrated embodiment, the tactile indicator 126 is a recessed groove. A low-light visible element 122 is received by the groove. The tactile indicator pierces the perimeter 114 of the turret 112, which permits the tip 124 of the low-light visible element to be exposed and visible laterally from and perpendicular to an axis 146 defined by the rotation of the turret 112, as it would be viewed by a shooter positioned to look through the scope's eyepiece. Both the low-light visible element and the groove enable the rotational position of the turret 112 to be determined by touch in very dark conditions when even the low-light visible element is not visible or when the turret is not in view or being looked at. In the illustrated embodiment, the low-light visible element 122 is a fiber optic filament or rod.

The top portion 132 of the perimeter 114 of the turret 112 is knurled or otherwise textured or ruggedly contoured to facilitate gripping for rotation of the turret 112. Bolts 128 connect the turret 112 to a turret screw 136 protruding from the bottom 118 of the turret 112 through a turret base 34. The bolts 128 permit the turret 112 to be re-zeroed or completely detached from the turret screw. The turret screw is operably connected to the movable optical element and adjusts the optical axis based on the number of clicks that have been dialed in on the turret 112.

Indicia 120 are positioned around the perimeter 114 and correspond to clicks of the turret 112. Indicia typically include tick marks, each corresponding to a click, and larger tick marks at selected intervals, as well as numerals indicating angle of adjustment or distance for bullet drop compensation. Each of the tick marks receives a tritium vial 140, which illuminates both its tick mark and any adjacent numerals. A sleeve 142 encircles the perimeter above the indicia 120. The sleeve 142 is opaque except for a cutout window 138, which could also be made of a transparent or translucent material. An illuminated indicium 120 is visible through the window when the window is positioned over the indicium 120. In the illustrated embodiment, the tactile indicator and low-light visible element are positioned to correspond to 0 Minutes of Angle of adjustment to the optical axis (no clicks). In this position, the low-light visible element and tactical indicator point towards the user and are aligned with the "0" indicium. The window is also aligned with the "0" indicium, making the "0" indicium and its corresponding tick mark and tritium vial visible to the user.

Figure 6:
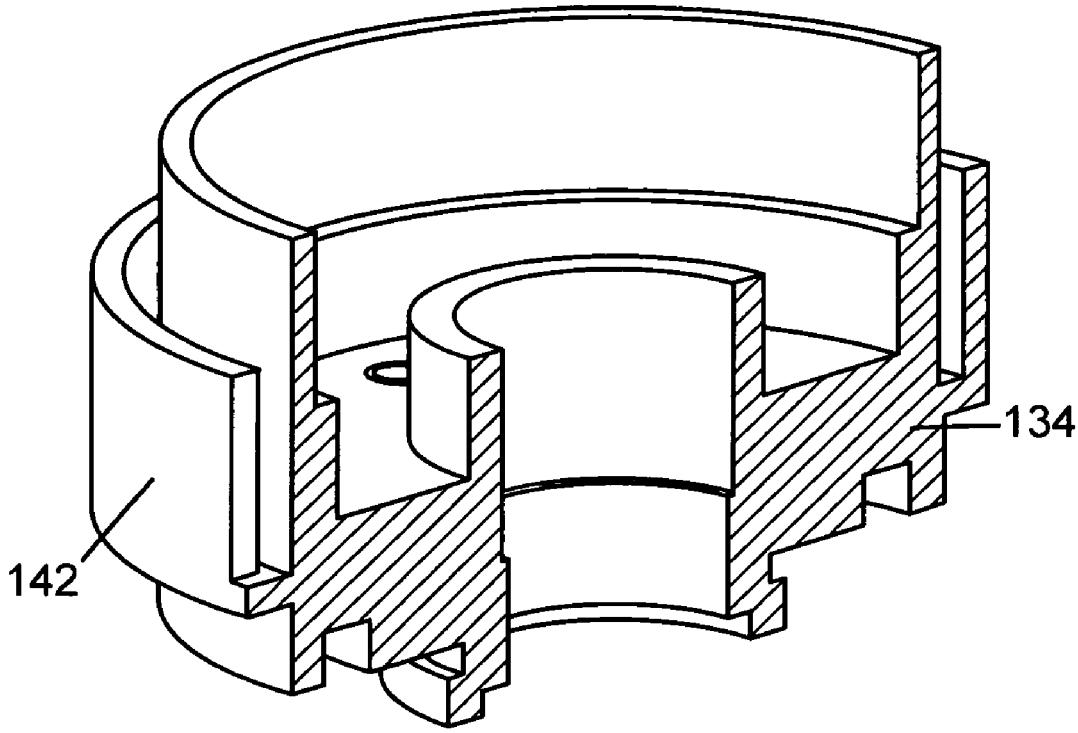
FIG. 6 is a top perspective sectional view of the alternative embodiment of the turret base of the present invention.

FIG. 6 illustrates the alternative embodiment of the improved turret base 134 of the present invention. The turret base is mated to the scope body and remains in a fixed position with respect to the scope body when the turret is rotated. Therefore, the turret base holds the sleeve 142 in a fixed position also with the window 138 facing the user. As a result, as clicks are dialed in on the turret 112, the turret rotates with respect to the sleeve, resulting in the quantity of dialed in clicks appearing in the window 138.

While a current embodiment of the rifle scope with a low-light visible element has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. And although providing an aid for counting the number of revolutions that have been dialed in on a turret has been described, it should be appreciated that the rifle scope with a low-light visible element herein described is also suitable for use as a quick sighting device in an emergency situation. Furthermore, a wheel with transparent indicia illuminated by a tritium vial or other light source could be placed behind a window in the turret. The wheel would rotate as revolutions are dialed in on the turret, resulting in an analog display of the quantity of dialed in clicks appearing in the window. Alternatively, a digital readout could be positioned behind a window in the turret that would display the quantity of dialed in clicks. The digital readout could be light emitting diodes, a liquid crystal display, or could be a liquid crystal display illuminated by an electroluminescent panel.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A rifle scope with a low-light visible element comprising:

a scope body;

a movable optical element defining an optical axis connected to the scope body, a turret operably connected to the optical element for adjusting the optical axis;

a low-light visible element attached to the turret such that the rotational position of the turret can be determined by viewing the low-light visible element; and wherein the low-light visible element is an elongated member having a substantial portion of its length exposed to ambient light and an exposed end visible laterally from an axis defined by the turret's rotation.

2. The rifle scope of claim 1, further comprising the scope body having a rear, wherein the exposed end of the low-light visible element is visible when viewed from the rear of the scope body when the optical element is in a selected reference position.

3. The rifle scope of claim 2, wherein the selected reference position corresponds to 0 Minutes of Angle of adjustment to the optical axis.

4. The rifle scope of claim 1, further comprising a tactile indicator attached to the turret such that the rotational position of the turret can be determined by touch.

5. The rifle scope of claim 4, wherein the tactile indicator is aligned with the axis of the scope body when the tactile indicator is in a selected reference position.

6. The rifle scope of claim 5, wherein the selected reference position corresponds to 0 Minutes of Angle of adjustment to the optical axis.

7. The rifle scope of claim 4, wherein the tactile indicator is an elongated surface feature.

8. The rifle scope of claim 4, wherein the tactile indicator is a channel defined in the top of the turret and receiving the low-light visible element.

9. The rifle scope of claim 7, wherein the tactile indicator is at least one of the group comprising a recessed groove and the low-light visible element.

10. The rifle scope of claim 1, further comprising an indicium attached to the turret.

11. The rifle scope of claim 10, wherein the indicium is attached to the turret such that the rotational position of the turret can be determined by viewing the indicium.

12. The rifle scope of claim 10, further comprising the turret having a perimeter, wherein the indicium is attached to the perimeter of the turret.

13. The rifle scope of claim 10, wherein the indicium is a luminous marker.

14. The rifle scope of claim 10, further comprising the scope body having a rear, wherein the indicium is visible when viewed from the rear of the scope body when the optical element is in a selected reference position.

15. The rifle scope of claim 14, wherein, the selected reference position corresponds to 0 Minutes of Angle of adjustment to the optical axis.

16. The rifle scope of claim 10, wherein the indicium is visible in low-light conditions.

17. The rifle scope of claim 10, wherein the indicium is illuminated by the low-light visible element.

18. A rifle scope with a low-light visible element comprising:

a scope body;

a movable optical element defining an optical axis connected to the scope body;

a turret operably connected to the optical element for adjusting the optical axis;

a low-light visible element attached to the turret such that the rotational position of the turret can be determined by viewing the low-light visible element; and wherein the low-light visible element is an elongated light-transmissive body.

19. The rifle scope of claim 18, further comprising a tactile indicator attached to the turret such that the rotational position of the turret can be determined by touch.

20. The rifle scope of claim 19, wherein the tactile indicator is aligned with the axis of the scope body when the tactile indicator is in a selected reference position.

21. The rifle scope of claim 20, wherein the selected reference position corresponds to 0 Minutes of Angle of adjustment to the optical axis.

22. The rifle scope of claim 19, wherein the tactile indicator is an elongated surface feature.

23. The rifle scope of claim 19, wherein the tactile indicator is a channel defined in the top of the turret and receiving the low-light visible element.

24. The rifle scope of claim 22, wherein the tactile indicator is at least one of the group comprising a recessed groove and the low-light visible element.

25. The rifle scope of claim 18, further comprising an indicium attached to the turret.

26. The rifle scope of claim 25, wherein the indicium is attached to the turret such that the rotational position of the turret can be determined by viewing the indicium.

27. The rifle scope of claim 25, further comprising the turret having a perimeter, wherein the indicium is attached to the perimeter of the turret.

28. The rifle scope of claim 25, wherein the indicium is a luminous marker.

29. The rifle scope of claim 25, further comprising the scope body having a rear, wherein the indicium is visible when viewed from the rear of the scope body when the optical element is in a selected reference position.

30. The rifle scope of claim 29, wherein the selected reference position corresponds to 0 Minutes of Angle of adjustment to the optical axis.

31. The rifle scope of claim 25, wherein the indicium is visible in low-light conditions.

32. The rifle scope of claim 25, wherein the indicium is illuminated by the low-light visible element.

33. A rifle scope with a low-light visible element comprising:

a scope body;

a movable optical element defining an optical axis connected to the scope body;

a turret operably connected to the optical element for adjusting the optical axis;

a low-light visible element attached to the turret such that the rotational position of the turret can be determined by viewing the low-light visible element; and wherein the low-light visible element is selected from the group comprising fiber-optic filaments, rods, tritium vials, fluorescent materials, and luminous paint.

34. The rifle scope of claim 33, further comprising a tactile indicator attached to the turret such that the rotational position of the turret can be determined by touch.

35. The rifle scope of claim 34, wherein the tactile indicator is aligned with the axis of the scope body when the tactile indicator is in a selected reference position.

36. The rifle scope of claim 35, wherein the selected reference position corresponds to 0 Minutes of Angle of adjustment to the optical axis.

37. The rifle scope of claim 34, wherein the tactile indicator is an elongated surface feature.

38. The rifle scope of claim 34, wherein the tactile indicator is a channel defined in the top of the turret and receiving the low-light visible element.

39. The rifle scope of claim 37, wherein the tactile indicator is at least one of the group comprising a recessed groove and the low-light visible element.

40. The rifle scope of claim 33, further comprising an indicium attached to the turret.

41. The rifle scope of claim 40, wherein the indicium is attached to the turret such that the rotational position of the turret can be determined by viewing the indicium.

42. The rifle scope of claim 40, further comprising the turret having a perimeter, wherein the indicium is attached to the perimeter of the turret.

43. The rifle scope of claim 40, wherein the indicium is a luminous marker.

44. The rifle scope of claim 40, further comprising the scope body having a rear, wherein the indicium is visible when viewed from the rear of the scope body when the optical element is in a selected reference position.

45. The rifle scope of claim 44, wherein the selected reference position corresponds to 0 Minutes of Angle of adjustment to the optical axis.

46. The rifle scope of claim 40, wherein the indicium is visible in low-light conditions.

47. The rifle scope of claim 40, wherein the indicium is illuminated by the low-light visible element.

* * * * *